US008443551B2

(12) United States Patent
Walhorn

(10) Patent No.: US 8,443,551 B2
(45) Date of Patent: May 21, 2013

(54) SLIDING DOOR

(75) Inventor: Oliver Walhorn, Werther (DE)

(73) Assignee: Dorma GmbH + Co. KG, Ennepetal (DE)

( * ) Notice: Subject to any disclaimer, the term of this patent is extended or adjusted under 35 U.S.C. 154(b) by 237 days.

(21) Appl. No.: 12/889,934

(22) Filed: Sep. 24, 2010

(65) Prior Publication Data

US 2011/0067313 A1 Mar. 24, 2011

(30) Foreign Application Priority Data

Sep. 24, 2009 (DE) ..... 10 2009 042 486

(51) Int. Cl.
*E05F 11/54* (2006.01)
*E05F 5/08* (2006.01)
*E05F 5/10* (2006.01)

(52) U.S. Cl.
USPC ..... 49/404; 49/425; 16/71

(58) Field of Classification Search
USPC ..... 49/404, 409, 425; 16/49, 51, 58, 16/70, 71, 72
See application file for complete search history.

(56) References Cited

U.S. PATENT DOCUMENTS 3,650,071 A * 3/1972 Tanner ..... 49/411
3,887,962 A * 6/1975 Mills ..... 16/72
RE28,639 E * 12/1975 Crocker ..... 49/264
3,938,282 A * 2/1976 Goyal ..... 49/137
4,004,372 A * 1/1977 Beard et al. ..... 49/404
4,301,623 A * 11/1981 Demukai ..... 49/404
4,471,575 A * 9/1984 Stout ..... 49/404
4,649,598 A * 3/1987 Kinsey et al. ..... 16/81
4,656,781 A * 4/1987 Niekrasz et al. ..... 49/404
4,872,239 A * 10/1989 Ferguson et al. ..... 16/64
5,131,188 A * 7/1992 Hutchison et al. ..... 49/404
5,251,402 A * 10/1993 Richardson et al. ..... 49/404
5,313,739 A * 5/1994 Nelson et al. ..... 49/404
5,517,719 A * 5/1996 Christ ..... 16/49
5,622,007 A * 4/1997 Archer ..... 49/404
6,055,777 A * 5/2000 Rekioja ..... 49/360
6,151,753 A * 11/2000 Salutzki ..... 16/62
6,578,320 B1 * 6/2003 Munton ..... 49/404
6,691,465 B1 * 2/2004 Stephan ..... 49/404
7,065,831 B2 * 6/2006 Elmer ..... 16/91
7,124,469 B2 * 10/2006 Tsekhanovsky et al. ..... 16/79
7,356,878 B2 * 4/2008 Foster ..... 16/71
7,421,761 B2 * 9/2008 Johnson ..... 16/60
7,464,437 B2 * 12/2008 Song ..... 16/79
2003/0234604 A1 * 12/2003 Lin ..... 312/334.6
2005/0273975 A1 * 12/2005 Foster ..... 16/51
2007/0101539 A1 * 5/2007 Sutterlutti et al. ..... 16/49
2007/0186481 A1 * 8/2007 Tomita et al. ..... 49/409
2008/0092447 A1 * 4/2008 Bienek ..... 49/340
2008/0092452 A1 * 4/2008 Chubb et al. ..... 49/458
2009/0273129 A1 * 11/2009 Zimmer et al. ..... 267/170

* cited by examiner

*Primary Examiner* — Katherine Mitchell
*Assistant Examiner* — Justin Rephann
(74) *Attorney, Agent, or Firm* — Cozen O'Connor

(57) ABSTRACT

A sliding door with a door leaf, which is suspended from two carriages and displaceably guided along a roller rail profile, which is disposed at a wall or at a ceiling, the sliding door having at least one closing device, which is suitable to displace the decelerated door leaf into a closed position. The at least one carriage has a carrier, at or in which the closing device is disposed.

11 Claims, 2 Drawing Sheets

SLIDING DOOR

BACKGROUND OF THE INVENTION

1. Field of the Invention

The present invention relates to a sliding door with a door leaf suspended from at least one carriage and displaceably guided along a roller rail profile disposed at a wall or at a ceiling. The sliding door includes a closing device, which is suitable to displace the decelerated door leaf into a closed position.

2. Description of the Related Art

The problem with sliding doors is that very often the doors, when being carelessly opened or closed, impact on an end stop; this can be very loud and can also destroy a door, such as a glass door. If the sliding door is closed with too much force, it will often strike against the end stop which can only absorb a portion of the energy, such that the sliding door bounces back and remains in a not completely closed position. Closing devices are known that displace the sliding door into a final position and simultaneously achieve a dampening effect.

When opening a sliding door with too much force, this results very often in the problem that, although the first user is able to easily pass the door, as he/she has triggered the opening procedure, the sliding door simultaneously returns into the partially closed position and the following user of the sliding door bounces against it with his shoulder or side; whereby on the one hand there is a risk of injury and, on the other hand, the sliding door will start to swing perpendicularly to the opening direction and thus may be prone to damage.

SUMMARY OF THE INVENTION

It is an object of the invention to provide a sliding door, in which a closing device achieves a displacement into a terminal position and simultaneously a dampening effect for both, the opening procedure and the closing procedure. In this case, the closing device is preferably as compact as possible and should be retrofittable to existing sliding doors.

According to one embodiment of the invention, the closing device is disposed at or in the carrier of the carriage. This disposition type of the closing device at or in the carrier of the carriage results in the closing device being moved with the door leaf and being able to be disposed within the profiles. Thus a visually appealing and compact solution can be achieved, in which the closing device is not visible for the user of the sliding door.

One advantageous embodiment of the invention results from a spring-dampening element being utilized as the closing device, which can be inexpensively purchased as a standard structural component.

In a preferred embodiment, the door leaf is directly or indirectly connected to the carriage via a clamping device or an attachment device, for example via a bracket, centrally disposed at the carriage. This device may be a single point fixing or an adhesive adapter, which preserves the integrity of the door leaf. In this type of door leaf suspension, the door leaf is easily rotatable about the point of attachment of the carriage and thus is able to auto-adjust. Inaccuracies in the production and mounting process are thus automatically compensated.

In a preferred embodiment, one or more adhesive adapters, which are glued to the border area of the door leaf, are utilized as the attachment. The advantage is that the integrity of the door leaf is maintained. In particular with glass doors, the advantage is that expensive and complicated boring can be foregone, which otherwise would introduce tensions into the glass which frequently result in breaking of glass on the construction site. The previous attachment of fittings or roller carriages at glass panes of undampened doors requires large glue surfaces, because the stop impulse that pulls on the glue location, sooner or later results in failure of the glue location. Equipping a sliding door with a dampened closing device reduces the stop impulse, such that the glue surfaces of the fittings can be smaller and do not fail any more. Due to the inventive combination of a dampened closing device with adhesive fittings, very compact carriages can be realized, in which the glass door does not require any bores and the fittings are invisible to the user.

In another embodiment, the carrying rollers of the carriages are disposed at opposite ends of the carrier, such that—in combination with the easy rotating self-adjustment between carriage and door leaf—roller unevenness can be compensated. The door moves smoothly and straight.

Another improvement is achieved if a closing device is disposed in each carriage, which devices act in opposite directions with regard to each other. Thereby one closing device works for the opened position and the other one for the closed position of the sliding door.

Each spring-dampening element preferably has a catch that cooperates with an associated release disposed at the roller rail profile. The closing-dampening function can be thus adjusted separately and independently from each other for both the opened position and the closed position. An individual adjustment is likewise achieved in that the releases can be displaced within the roller rail profile into the displacement direction of the door leaf.

Another advantageous solution is achieved in that at least one end stop, which cooperates with a carriage, is disposed in the roller rail profile. Here again, a solution for an impact protection is possible which is invisible to a user of a sliding door.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Hereinafter, further measures enhancing the invention will be illustrated in detail in conjunction with the description of one preferred embodiment of the invention based on the Figures, in which.

DETAILED DESCRIPTION OF THE PRESENTLY PREFERRED EMBODIMENTS

Figure 1:
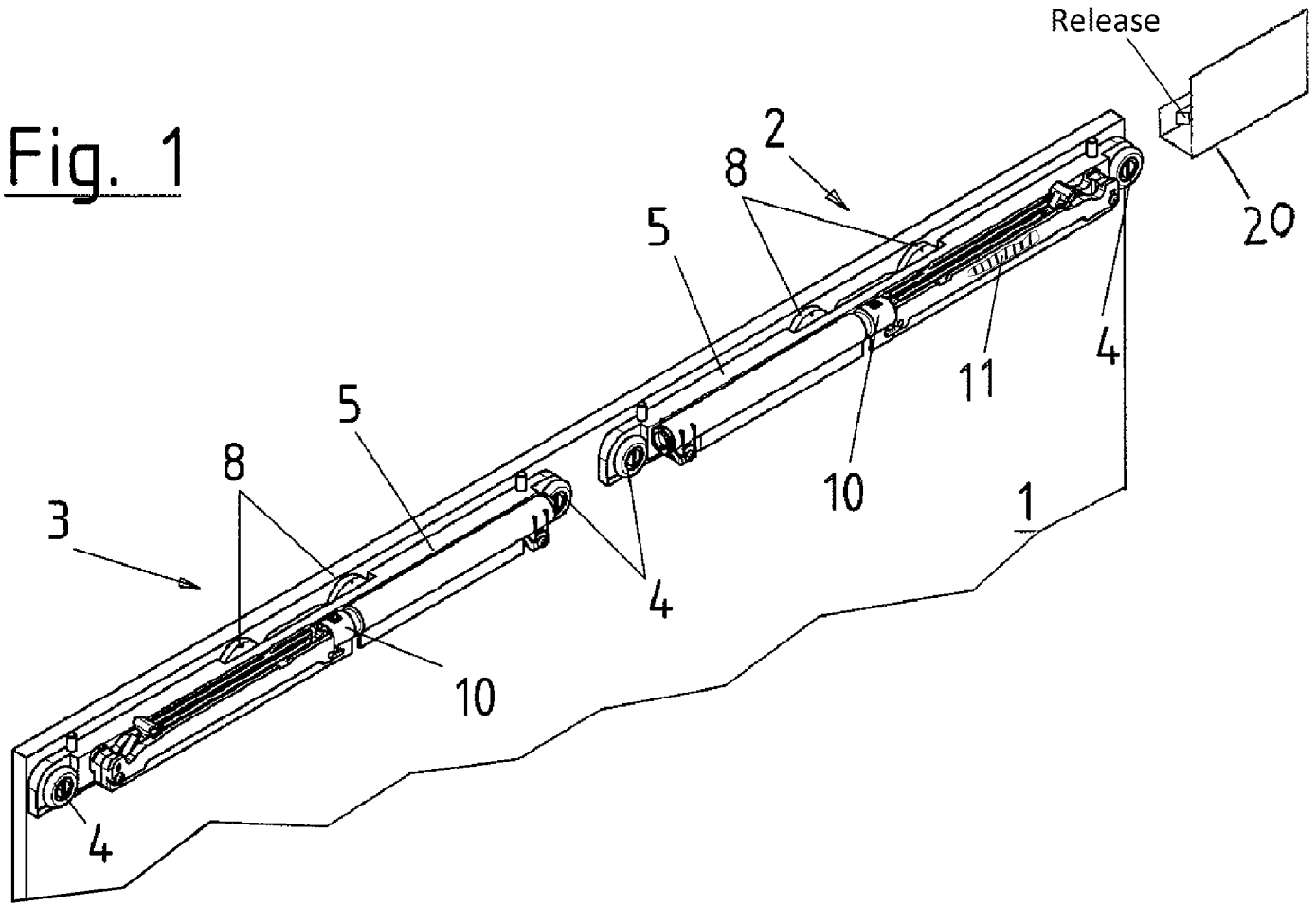
FIG. 1 is an illustration of the entire door leaf with the carriage.

In FIG. 1, the inventive sliding door is illustrated which comprises a door leaf 1 with two carriages 2, 3. The carriages 2, 3 guide the door leaf 1 in a displaceable manner in a roller rail profile 20, wherein the roller rail profile is directly or indirectly attached to a wall or to a ceiling. The door leaf 1 may consist of glass, wood or another arbitrary material. Each carriage 2, 3 has a carrier 5, one carrying roller 4 each being disposed at the opposite ends of the carrier. In this case, the carrying rollers 4 are disposed for example in a depression at the carrier 5, such that the carrier 5 can be configured with a minimum depth.

The door leaf 1 is attached to the carrier 5 of the carriages 2, 3 by a clamping device or an attachment device. These devices may consist of a single point fixing, in which the clamping element engages in a bore of the door leaf 1 and clampingly retains the latter.

Figure 2:
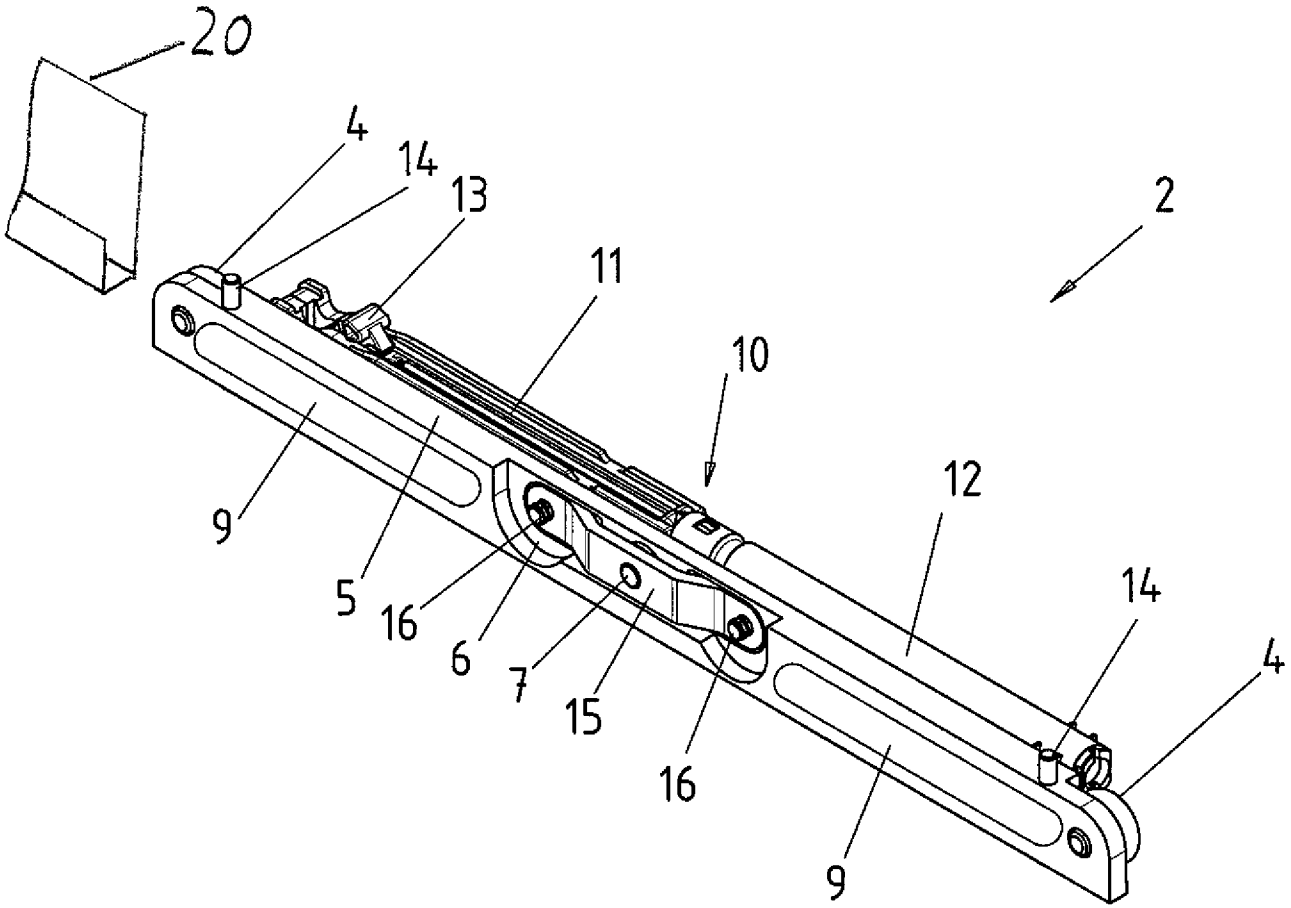
FIG. 2 is a perspective illustration of the closing device.

The attachment device may also consist of an adhesive adapter 8 attached to the door leaf 1 in a glued manner. In both embodiments, the carriage 2, 3 is attached to the carrier 5 by an attachment 7 that is centrally disposed at the carrier 5. (FIG. 2). In this embodiment, the attachment 7 connects the carrier 5 to a bracket 15, at which the adhesive adapters 8 are disposed by screws 16. The entire roller carriage 2 is rotatable about the axis of the attachment 7 in a certain range, such that the door leaf 1 is auto-adjustable. This embodiment shows a heavy glass leaf 1 suspended from the carriages 2 and 3 by four adhesive adapters 8 in total.

With lighter door leaves 1, each carriage may be attached to only one adhesive adapter 8, wherein in this case, the bracket 15 can be omitted. The adhesive adapter 8 is then directly connected to the attachment 7, about which the carriage 2 or 3 is rotatable.

For the carriages 3 to bear as close as possible against the door leaf 1, a depression 6 is disposed in the carrier 5, which accommodates the clamping element or the attachment element, respectively the bracket 15.

In order to make it easy to mount the carriages 2, 3 to the door leaf 1, the attachment 7 is configured as a screw, which—depending on the type of embodiment—passes, at least partially, through the carrier 5.

To avoid damaging the surface of the door leaves 1 when mounting the carriage 2, 3, a glass protection 9 is disposed between the carriages 2, 3 and the door leaf 1. This protection may be already securely pre-mounted on the carrier 5.

A closing device, configured as a spring-dampening element 10, is disposed at the carrier 5. In contrast to known stationary closing devices, which are disposed in wall profiles or ceiling profiles or in depressions of the floor, the inventive closing device moves along with the door leaf 1.

FIG. 2 reveals that the closing device, in the shape of a spring-dampening element 10, is disposed at the carrier 5.

Each spring-dampening element 10 has a spring 11, a damper 12 and a catch 13. Preferably a compression spring is utilized as the spring 11, which forces a non-illustrated piston rod, projecting from the damper 12, into a maximum extended position, in which the spring 11 is relaxed. The spring 11 is held in the compressed position in a so-called parking position, until—by displacing the door leaf 1—a release, which is stationarily disposed in the guiding profile, actuates the catch 13 and thus releases and relaxes the spring 11. When the spring 11 relaxes, it pushes, respectively accelerates the door leaf 1 into an opened or closed position. A deceleration force of the damper 12, which decelerates the door leaf 1, counteracts the acceleration force, and thus the door leaf moves silently and impact-free into an opened or closed position.

The damper 12 may be configured as a pneumatic or hydraulic damper, which has a piston, which is disposed at a piston rod and is displaceably disposed within a cylinder. In this case, the dampening effect may be achieved in an upper and/or lower terminal position of the piston, in that a liquid or gaseous medium is compressed and/or displaced by the piston.

In order to achieve a closing function and a dampening function in both directions of movement of the door leaf 1, each carriage 2, 3 has a spring-dampening element 10 which are disposed to act in opposite directions. A separate release is stationarily disposed in the guiding profile for each spring-dampening element 10.

Respectively one end stop, against which the carriages 2, 3 travel, is disposed in each roller rail profile for the opened and closed position, in order to prevent the door leaf 1 from impacting on a wall or on a stationary lateral panel. As a protection against a possible malfunction, each carriage 2, 3 has an adjustable lift-off protection 14 at each end.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A sliding door comprising:

a door leaf;

at least one closing device configured as a spring-dampening element to displace the door leaf during movement into a closed position and comprising:

a damper;

a spring extending longitudinally from the damper; and a catch arranged at an end of the spring opposite the damper; and at least one carriage from which the door leaf is suspended comprising:

a carrier at which the closing device is disposed; and a roller rail profile disposed at a wall or a ceiling in which the at least one carriage is displaceably guided, wherein the catch cooperates with an associated release disposed in the roller rail profile.

2. The sliding door according to claim 1, wherein the door leaf is one of directly or indirectly connected to the carriage via at least one of a clamping device and an attachment device, wherein the at least one of the clamping device and the attachment device is disposed substantially centrally at the carriage.

3. The sliding door according to claim 2, wherein the clamping device has a single fixing point.

4. The sliding door according to claim 2, wherein the attachment device is an adhesive adapter.

5. The sliding door according to claim 2, wherein the carriage is rotateably attached to at least one of:

at least two clamping devices and two attachment devices disposed at a bracket.

6. The sliding door according to claim 1, wherein the carrier further comprises a depression, the depression configured to accommodate at least one of the clamping device, the attachment device, and a bracket.

7. The sliding door according to claim 1, wherein the at least one carriage comprises two carrying rollers disposed at opposite longitudinal ends of the carrier.

8. The sliding door according to claim 1, wherein the damper is one of a hydraulic damper and a pneumatic damper.

9. The sliding door according to claim 1, further comprising a second carrier in which a second closing device is disposed.

10. The sliding door according to claim 9, wherein the at least one closing device acts in a direction opposite second closing device.

11. The sliding door according to claim 1, wherein the at least one carriage further comprises at least one lift-off protection.

* * * * *